United States Patent [19]

Scheer

[11] 4,148,181

[45] Apr. 10, 1979

[54] SYSTEM FOR CONTROLLING THE STRIKING MECHANISM OF A TIMEPIECE

[75] Inventor: Erich Scheer, St. Georgen-Peterzell, Fed. Rep. of Germany

[73] Assignee: Kieninger & Obergfell, Fabrik für Technische Laufwerke und Apparate, St. Georgen, Fed. Rep. of Germany

[21] Appl. No.: 795,769

[22] Filed: May 11, 1977

Related U.S. Application Data

[63] Continuation-in-part of Ser. No. 775,756, Mar. 9, 1977, abandoned.

[30] Foreign Application Priority Data

Mar. 10, 1976 [DE] Fed. Rep. of Germany ..... 2609871

[51] Int. Cl.[2] ..... G04B 21/12; G04C 21/36

[52] U.S. Cl. ..... 58/13

[58] Field of Search ..... 58/8, 10, 12, 13, 19 R, 58/19 A, 19 B, 38 R, 38 A, 57.5, 152 B

[56] References Cited

FOREIGN PATENT DOCUMENTS 2556765 7/1977 Fed. Rep. of Germany ..... 58/13

*Primary Examiner*—Stanley J. Witkowski

*Attorney, Agent, or Firm*—Karl F. Ross

[57] ABSTRACT

A first contact arm on the minute shaft of a clockwork switches, once every 30 minutes, the mode of energization of an electronic gating circuit with two sections in the inputs of an inverting anticoincidence (NOXOR) gate working into a setting input of a flip-flop which controls the driving circuit of a striking mechanism, each section having two parallel branches of relatively inverting character and with a relative phase delay whereby any switchover results in a brief de-energization of that setting input and thus in a setting of the flip-flop. A pulse generator, included in or energized by the driving circuit, works into a stepping input of a binary pulse counter provided with four output leads whose pattern of energization represents the numerical values from 1 through 12. A logic network, connected to a resetting input of the flip-flop and to a clearing input cf the pulse counter, discriminates between switch-overs at the full hour and at the half-hour in response to the state of energization of the gating circuit; on the half-hour, the flip-flop is reset and the pulse counter is cleared upon the energization of the No. 1 output lead of the counter, whereas on the full hour these events take place under the control of a second contact arm carried on the hour shaft of the clockwork whenever the pulse count matches the position of that contact arm.

29 Claims, 26 Drawing Figures

SYSTEM FOR CONTROLLING THE STRIKING MECHANISM OF A TIMEPIECE

CROSS-REFERENCE TO RELATED APPLICATION

This is a continuation-in-part of my pending application Ser. No. 775,756 filed Mar. 9, 1977 and now abandoned.

FIELD OF THE INVENTION

My present invention relates to an electronic system for the control of a striking mechanism in a timepiece, preferably an electric clock of the crystal-controlled type.

BACKGROUND OF THE INVENTION

The sounding of the hour by a variable number of strikes, and possibly also of the half-hour by a single strike, is conventionally accomplished with the aid of a trigger actuated by the minute shaft of the clockwork. The number of strikes is determined by a mechanical counter which usually comprises a toothed segment or rack displaced by an hour cam before each striking operation, the cam being driven by the hour shaft of the clockwork and having a generally spiral ramp surface composed of discrete dwells of different radii which advance the cam to a different extent from its home position. A solenoid-operated pawl retracts the rack, one tooth at a time, during the execution of the strikes; when the rack returns to its home position, the operation is stopped. Before the half-hour, the rack is advanced by just one tooth regardless of the position of the hour cam.

Such an electrically operated striking mechanism, originally intended mainly for tower clocks, has a large number of movable parts and is too bulky for use in more compact timepieces; it is also subject to malfunctions due to wear.

OBJECT OF THE INVENTION

The object of my present invention, accordingly, is to provide a more compact system for the control of an electric striking mechanism which has few moving parts, does not require any mechanical or electromechanical prime mover and is positively coupled with the clockwork so that its operation is unequivocally tied in with the position of the clock hands. Thus, an adjustment of the setting of the timepiece should not have any effect upon the synchronization between the time indication and the operation of the striking mechanism.

SUMMARY OF THE INVENTION

I realize this object, in accordance with the present invention, by the provision of a normally reset flip-flop with a set output connected to drive means for operating the striking mechanism, trigger means including a first rotating contact member coupled with the minute shaft of the clockwork for delivering a start signal to the setting input of the flip-flop at least once per hour to activate the drive means, electronic pulsing means synchronized with the striking mechanism for emitting a number of voltage pulses proportional (and preferably equal) to the number of strikes, and a pulse counter with a stepping input connected to the pulsing means and with output circuitry including a set of leads generating a pattern of energization determined by the count of the voltage pulses; this output circuitry forms part of deactivating means also including a second rotating contact member coupled with the hour shaft for delivering a stop signal to the resetting input of the flip-flop and to a clearing input of the pulse counter when the pattern of energization of the set of leads in the output circuitry of that counter bears a predetermined relationship with the position of the hour shaft, thereby arresting the striking mechanism and establishing a zero pulse count.

If the half-hour is also to be sounded, the trigger means comprises an electronic gating circuit which is switchable by the first contact member in a half-hour position and in a full-hour position thereof, the deactivating means further including a logic network connected to the gating circuit for generating the stop signal independently of the position of the hour shaft coinciding with the half-hour position of the minute shaft. Thus, the logic network may comprise a first gate and a second gate in cascade, the first gate having input connections to the gating circuit and to the lead which is energized by the pulse counter upon the sounding of the first strike, the second gate having an input connection to a point of the output circuitry of the pulse counter whose potential changes whenever the pattern of energization of the counter-output leads bears the aforementioned predetermined relationship with the position of the hour shaft. That pattern of energization may be the marking of one of 12 such output leads, connected to the counter via a decoding network; if the leads emanate directly from the stage outputs of the binary counter, that relationship may be the matching of the code of the binary count with a complementary (or possibly identical) four-bit code established by the coaction of the second contact member with four concentric contact arcs, three of them segmented. Such a match can be detected by a comparison network comprising four discriminating stages, designed preferably as OR gates in the case of complementary codes, working into a common coincidence (AND, NAND or NOR) gate.

According to another important feature of my invention, the gating circuit connected to the setting input of the flip-flop comprises two substantially identical sections terminating at respective inputs of an anticoincidence gate of the Exclusive-OR type, each of these sections being divided into a pair of parallel branches of relatively inverting character and with a relative phase delay that are connected to the respective input of the anticoincidence gate through a further logic gate which changes its state of conduction, in response to a switchover by the first contact member, during a brief interval determined by that phase delay in which the two branches carry signals of identical logical values. Depending upon the mode of connection of the gating circuit to the bank contact or contacts coacting with the first contact member, as will become apparent hereinafter, the further logic gate in each of its sections may be either a summing (OR) gate or a coincidence (NAND) gate. Advantageously, the relative inversion and phase delay is brought about by an odd number (preferably three) of cascaded inverters in one of the branches.

The bank contacts coacting with the two rotating contact members may be printed on a carrier plate traversed by the nested minute and hour shafts on which these contact members are mounted directly.

BRIEF DESCRIPTION OF THE DRAWING

The above and other features of my invention will now be described in detail with reference to the accompanying drawing in which.

SPECIFIC DESCRIPTION

Figure 1:
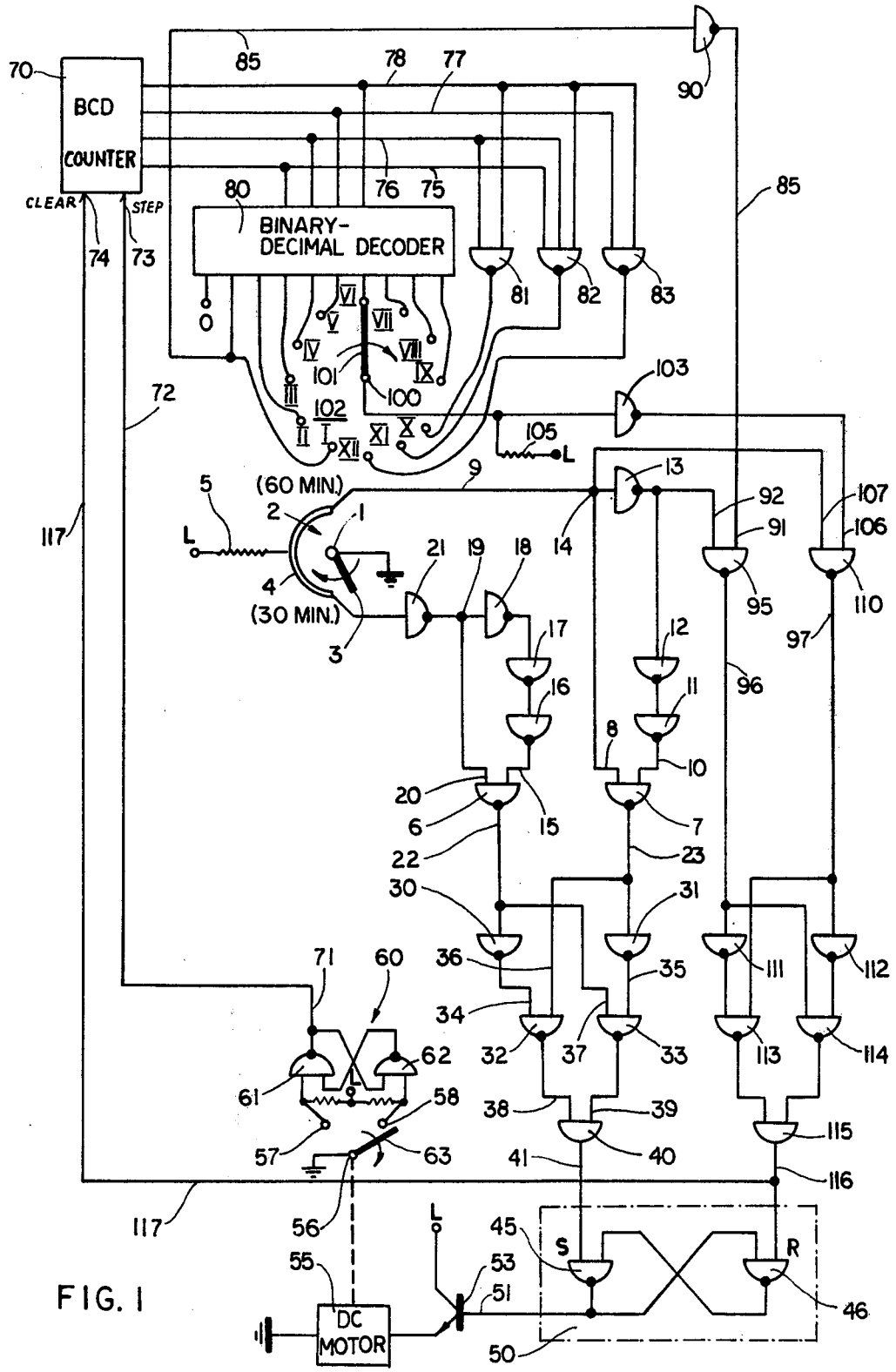
FIG. 1 is a circuit diagram of a system for the control of an electrical striking mechanism representing a first embodiment.

In FIG. 1 I have shown a minute shaft 1 of a conventional clockwork which actuates a switch 2 comprising a contact member 3 rotating with the minute shaft 1, designed as a wiper; contact member 3 sweeps an arcuate bank contact 4 during the 30-minute interval between half-hour and full hour. Bank contact 4 is printed on a carrier plate 132 (FIG. 9) within the clockwork controlling the electrical striking mechanism pursuant to my invention.

In the following description, symbol X will be used to designate any hour of the day whereas superscripts such as "00", "30" or "60" represent the minutes, so that $X^{30}$ symbolizes a half hour and $X^{60}$ indicates a full hour.

The switch 2 is so positioned in relation to the minute hand (not shown) mounted on shaft 1 that the wiper 3 will arrive at the bank contact 4 exactly at the beginning of the second half-hour, i.e. at $X^{30}$ o'clock, touching it and consequently closing the switch. The wiper 3 is permanently connected, as by a sliding contact, to a point of fixed potential (ground) of logical value "0". Bank contact 4, on the other hand, is connected to a source of potential of logical value "1" (designated L) via a resistor 5.

Two sections of a gating circuit including a pair of NAND gates 6 and 7 are connected in parallel to bank contact 4. NAND gate 7 has an input 8 connected directly to a line 9, tied to that bank contact, and an input 10 connected to a junction point 14 on line 9 by way of three cascaded inverters 11, 12 and 13 also having a delay function.

Similarly, three cascaded inverters 16, 17 and 18 are inserted between an input 15 of NAND gate 6 and a junction point 19 tied to the other input 20 of the same NAND gate 6. An additional inverter 21 lies between junction point 19 and bank contact 4.

Figure 2:
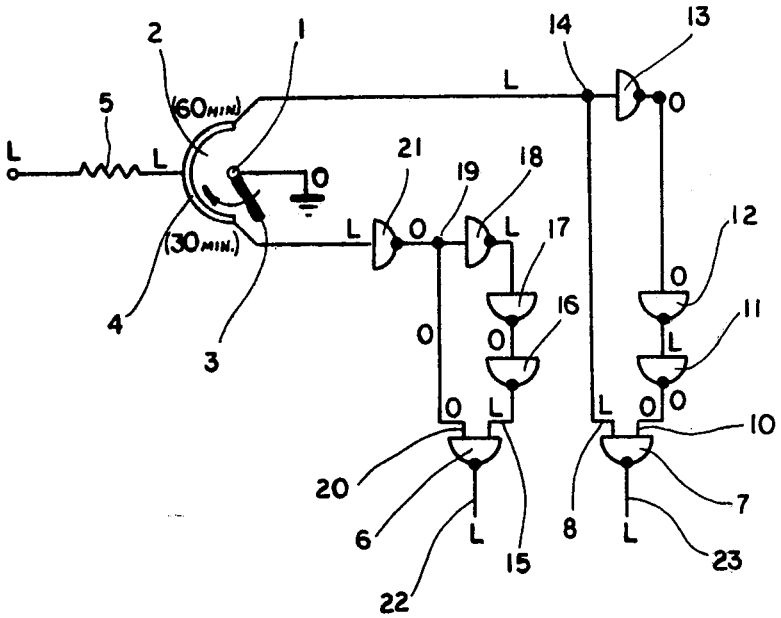
FIGS. 2–5 show part of the circuit diagram of FIG. 1 in four different phases of operation.

FIG. 2 shows the signal distributions at various points of the gating circuit controlled by switch 2, as it exists a short time before the initiation of the half-hour strike, i.e. at about $X^{25}$ o'clock. In this state, the signal L prevails at the outputs 22, 23 of the two NAND gates 6, 7.

Figure 3:
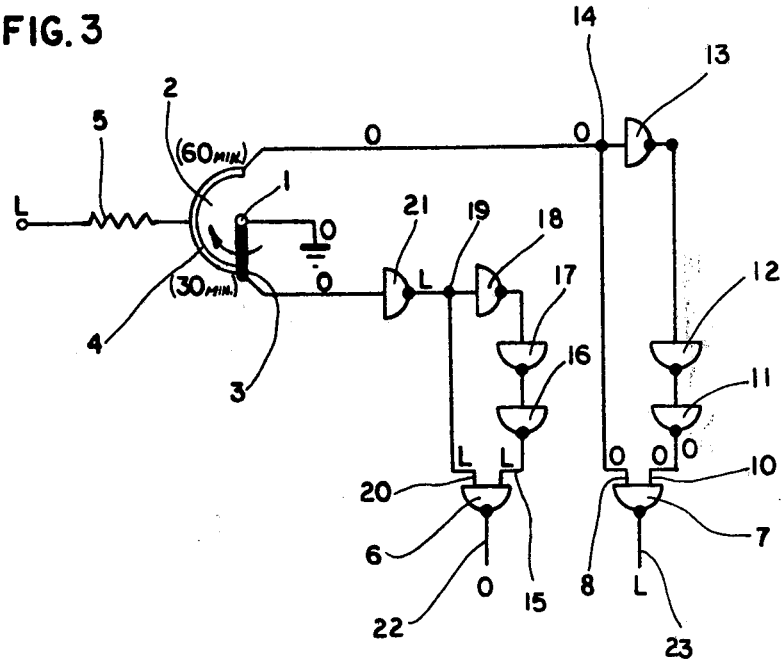

FIG. 3 shows the state of the circuit at the moment the half-hour strike is initiated, i.e. exactly at $X^{30}$ o'clock. As a result of the inverters 16–18 and 11–13, phase delays occur at the moment of switchover at $X^{30}$ o'clock, i.e when the switch 2 is closed, making the voltages at the inputs 15, 10 of the two NAND gates 6, 7 briefly equal to those of their inputs 20 and 8, respectively. As a consequence, at the moment the circuit between contact members 3 and 4 is closed, the signal condition shown in FIG. 3 prevails for a short period with NAND gate 6 cut off.

Thus, at instant $X^{30}$ the signal O/L occurs at the outputs 22, 23 of the two NAND gates 6, 7, while according to FIG. 2 the signal pair L/L existed at those outputs up to then.

The signal conditions shown in FIG. 3 are maintained only for an extremely short time which is sufficient, however, to effect the switching processes described below.

Figure 4:
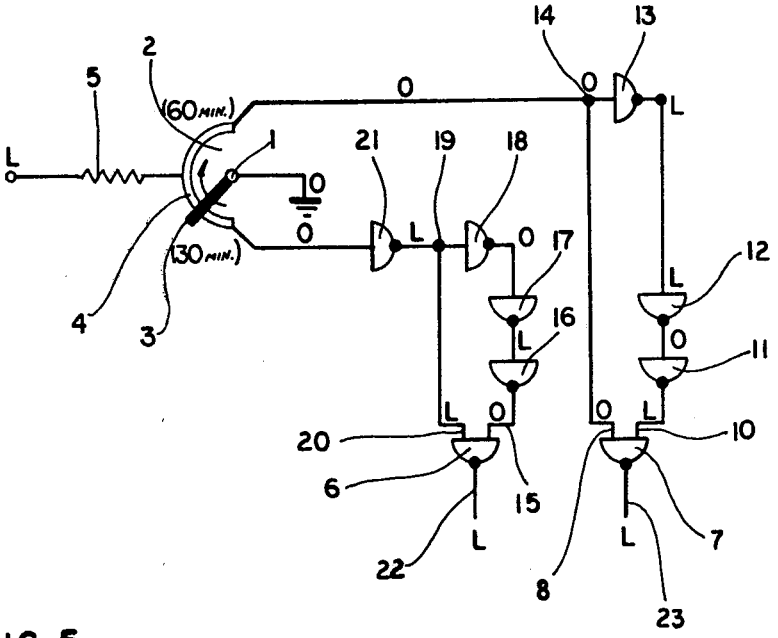

At the end of this brief interval, thus shortly after $X^{30}$ o'clock, the signal sequence shown in FIG. 4 occurs. This means that, with switch 2 still closed, the signal pair L/L reappears at the outputs 22, 23 of the two NAND gates.

At $X^{60}$ o'clock$=(X+1)^{00}$ o'clock, the contact member 3 of switch 2 leaves the arc 4, i.e. the switch is reopened. With the recurrence of the aforedescribed phase delay, the signal distribution shown in FIG. 5 occurs briefly at the full hour. In this case, therefore, the signal pair L/O appears at the outputs 22, 23 of the two NAND gates 6, 7.

It is evident from the foregoing that at the moment the switch 2 is reversed, i.e. closed or opened, opposite signals appear at the outputs 22, 23 of the two NAND gates whereas identical signal pairs exist there in the intermediate positions. According to a feature of my present invention, the emergence of unequal signals at the outputs of the NAND gates 6, 7 serves as a starting criterion for the activation of the electrical striking mechanism. For this purpose, a further logical relationship is required pursuant to the following Table.

TABLE

| Signal A (output 22) | Signal B (output 23) | Signal Y | (hours, minutes) |
|---|---|---|---|
| L | L | O | $X^{00}$–$X^{30}$ |
| | | | $X^{30}$–$X^{60}$ $(X+1)^{00}$ |
| O | L | L | $X^{30}$ |
| L | O | L | $X^{00}$, $X^{60}$ $(X+1)^{00}$ |
| O | O | O | does not appear at any time |

In the Table, Y represents a start signal (actually a complement thereof) satisfying the Boolean relationship $$\bar{A}\cdot B+A\cdot\bar{B}=Y$$

which is the function of an Exclusive-OR (XOR) gate or anti-coincidence circuit.

Figure 6:
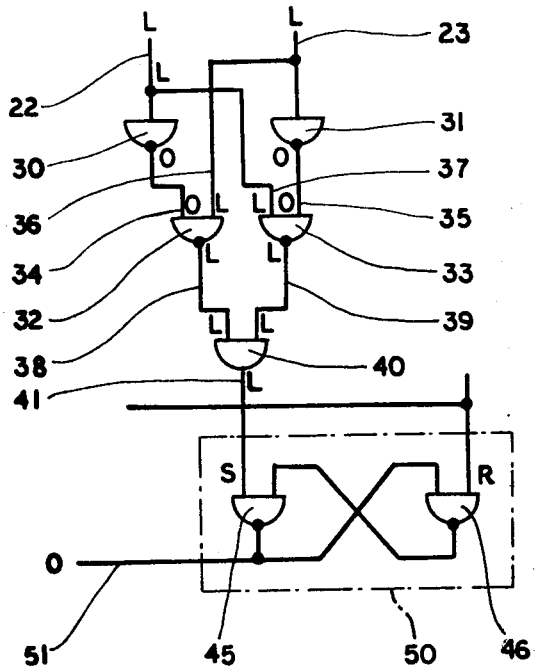
FIGS. 6 and 7 show another part of the circuit diagram of FIG. 1 in two different phases of operation.
Figure 7:
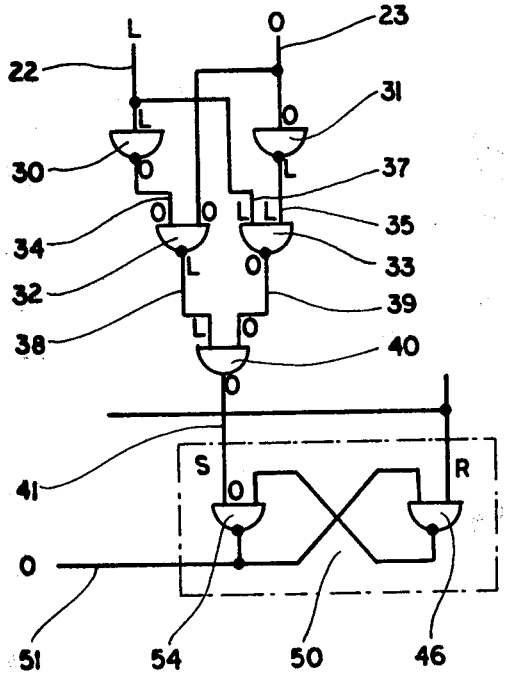

In accordance with a further feature of my invention, the start signal generated by the switch 2 at $X^{30}$ o'clock and at $X^{60}$ o'clock is fed to the setting input S of a flip-flop 50, shown in FIGS. 6 and 7 to comprise two cross-connected NAND gates 45, 46. Such a circuit requires as a setting signal a logical "0" which is obtained, advantageously, by a negation of the above function:

$$\overline{Y}=\overline{\overline{A}\cdot B+A\cdot\overline{B}}=\overline{(A\cdot\overline{B})\cdot(\overline{A}\cdot B)}$$

The latter logical function is performed by an inverting anti-coincidence circuit also known as a NOXOR gate.

This circuit comprises two inverters 30, 31 which are connected in series to the outputs 22, 23 of the NAND gates 6, 7 and work into respective inputs 34, 35 of two NAND gates 32, 33, whose two other inputs 36, 37 are tied directly to outputs 23 and 22, respectively.

The outputs 38, 39 of the two NAND gates 32, 33 are combined in an AND gate 40 whose output 41 is connected to the setting input S of flip-flop 50.

FIG. 6 illustrates the signal distribution along the linkages of the NOXOR gate 30–33, 40 which results when equal signals emitted by the NAND gates 6, 7 are applied to its inputs 22, 23. In this case, the signal L appears at the output of the AND gate 40 and at the input S of the NAND gate 45 of the flip-flop 50; thus, the flip-flop 50 remains reset and its output 51 is not energized. If, however, a pair of unequal signals appear at the connections 22, 23, i.e. L/O or O/L, the signal distribution illustrated in FIG. 7 occurs, i.e. the signal O appears at the output of AND gate 40, resulting in a setting of the flip-flop 50 and energization of output 51 which in turn unblocks a power transistor 53 feeding a drive motor 55 to actuate the associated striking mechanism (not shown in these Figures). As a result, the sound generator of this mechanism begins to produce a series of strikes.

The sound generator can comprise a conventional bell, gong tube or spiral gong. Strings or electronic oscillators could also be used. Another possibility is the provision of a mechanical tuning fork excited intermittently by the striker for conductively transmitting its audio frequencies to an amplifier for the energization of an electro-acoustic transducer.

A switch 56 has an arm 63 (FIG. 1) driven by motor 55 for alternately grounding two contacts 57, 58, thereby periodically setting and resetting a flip-flop 60 as long as the motor is energized. Flip-flop 60 serves to step a binary electronic counter 70 and insures that exactly one pulse per strike is transmitted to that counter. It consists of two cross-connected NAND gates 61, 62; output 71 of gate 61 is connected to a stepping input 73 of counter 70 by way of a lead 72.

In the well-known manner, this binary counter stores the pulse generated with each strike of the sounding mechanism and converts its counter into a binary code which appears on four stage outputs 75–78. This binary code is translated by a binary-decimal decoder 80, connected to outputs 75–78, into a marking (i.e. grounding) of one of ten output terminals O–IX which normally carry signal voltage L. Terminal O is grounded in the cleared state of counter 70.

In decoder 80, therefore, nine terminals I–IX are available for the counting of strikes. However, since up to 12 strikes have to be counted, the NAND gates conventionally present within the decoder are supplemented by three further NAND gates 81, 82 and 83 with output terminals X, XI and XII.

The output I of the binary-decimal decoder 80 is connected to an input 91 of a NAND gate 95 by a line 85 including an inverter 90. The other input 92 of this NAND gate 95 is tied to the junction of inverters 13 and 12 which form part of one of the circuit branches feeding the NAND gate 7. NAND gate 95 and a similar NAND gate 110 form part of a logic network discriminating between the half-hour and full-hour positions of switch arm 3.

After the half-hour strike has been triggered by the switch 2 and a pulse has been transmitted to the binary counter 70 by the flip-flop 60, the pattern of energization of the outputs 75–78 is changed from 0000 to 0001, whereupon the signal L appears at the output O of decoder 80 while the signal L is replaced at the adjacent output I by the signal O (positive logic being assumed in this case).

The signal O is fed to the inverter 90 by line 85 and its complement L is thus delivered to the input 91 of NAND gate 95.

Since, however, bank contact 4 is grounded at this moment also by the wiper arm 3, the signal L appears also at the input 92 of NAND gate 95 which therefore switches its output 96 to signal O.

At the time of the half-hour strike a contact arm or wiper 101 forming part of a switch 102 and rotating with the hour shaft 100 of the clockwork is located in a position between two decoder terminals I . . . XII and is energized with signal L via a resistor 105. An inverter 103 tied to wiper 101 then grounds an input 106 of NAND gate 110 having another input 107 connected to junction point 14 which is also grounded so that NAND gate 110 has an output signal L.

Thus, unlike signals are found at outputs 96 and 97 of the two NAND gates 95 and 110 which constitute respective inputs of an inverting anticoincidence (NOXOR) gate analogous to the one working into setting input S of flip-flop 50. This second NOXOR gate comprises two inverters 111, 112, two NAND gates 113, 114 and an AND gate 115. Unequal signals at the outputs 96, 97 of the two NAND gates 95, 110 produce an O-signal at the output 116 of AND gate 115 which is tied to a resetting input R of flip-flop 50. This results in a de-energization of line 51 and stops the drive motor 55 by cutting off its supply transistor 53. Motor 55 is designed to come to a halt in a position in which the switch arm 63 has reset the flip-flop 60. The flip-flop 50 does not switch over again until the signal O reappears at its setting input S, regardless of any interim change in the potential of its resetting input R. The output 116 of AND gate 115 is further connected by a lead 117 to a clearing input 74 of the binary counter 70 which therefore registers a zero count upon the resetting of flip-flop 50 so that signal L appears again at decoder output I.

As a result, NAND gate 95 conducts and switches the NOXOR gate 111–115, causing the signal L to reappear at its output 116; this change in signals, however, has no effect on the state of flip-flop 50 which remains reset.

During the execution of the hour strikes, the wiper 101 of switch 102 engages one of the outputs I–XII of decoding circuit 80–83 in accordance with the position of the hour hand of the clock mechanism. The wiper 101 is therefore electrically connected to the respective decoder output.

Figure 5:
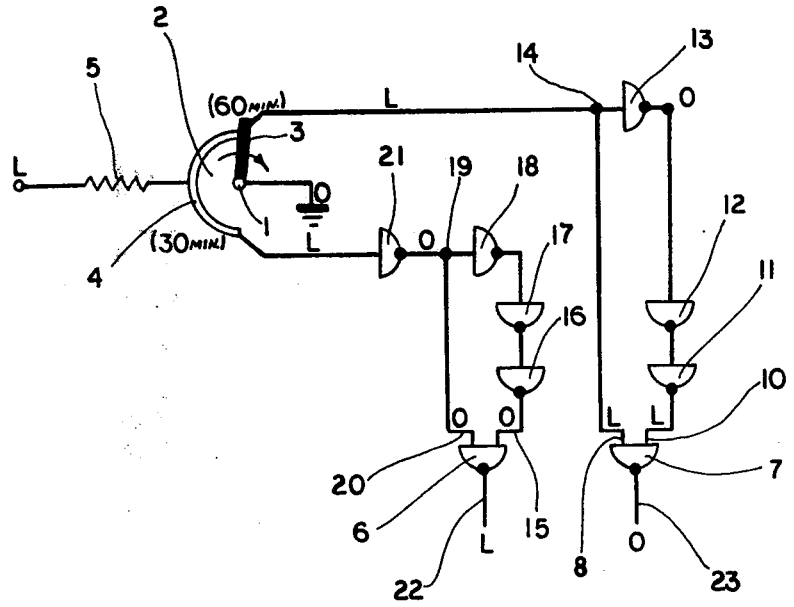

The start of the striking operation for the hours occurs in the manner already described with reference to FIGS. 5 and 6.

During the hour strike, the contact arc 4 just disengaged by arm 3 applies signal L by way of line 9 to the input 107 of NAND gate 110 whose other input 106 is initially maintained by inverter 103 at signal level O. Under these circumstances, NAND gate 110 conducts and carries an L-signal at its output 97. At the same time, an O-signal lies at the input 91 of NAND gate 95 because of the L-signal at decoder output I. An O-signal also appears at the input 92 of NAND gate 95, resulting in a signal L at its output 96.

Therefore, both outputs 96, 97 exhibit L-signals and the NOXOR gate 111–115 ineffectually energizes its output 116 with an L-signal. As soon as the pulse count matches the position of wiper 101, the grounding of the decoder terminal engaged by the wiper applies signal L to the input 106 of NAND gate 110, resulting in a changeover of the output 97 to signal O. This produces unequal signals at the inputs of NOXOR gate 111–115, giving rise to the stop signal O on resetting input R of flip-flop 50 and on clearing input 74 of binary counter 70, thereby arresting the striking mechanism.

Figure 8:
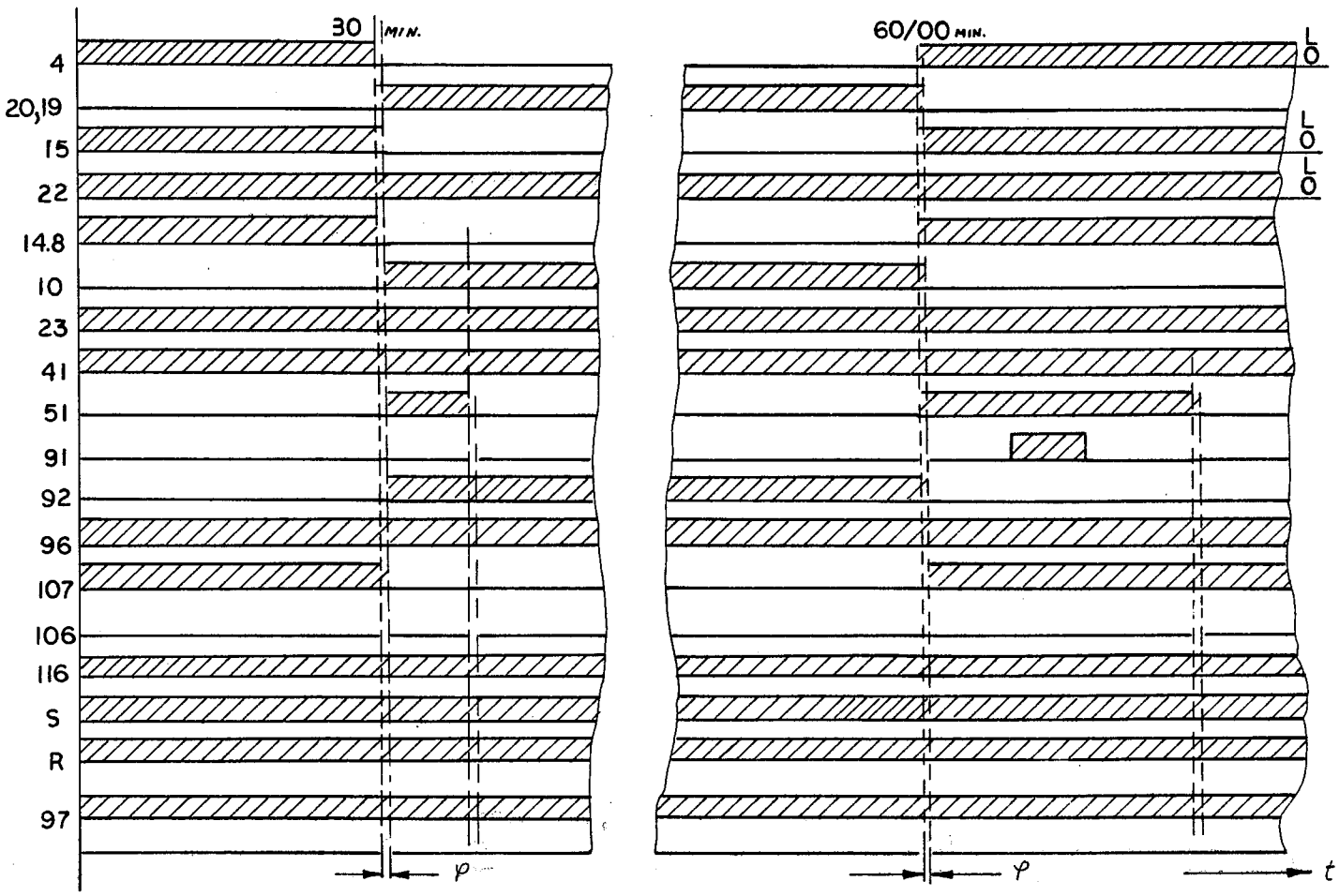
FIG. 8 is a set of graphs showing the state of energization of various components of the system of FIG. 1 during a one-hour operating cycle.

The mode of energization of the inputs and outputs of various logic elements participating in the operating cycle just described has been outlined in FIG. 8. The phase lag resulting in brief signal identities at terminals 15, 20 and 8, 10 at the half-hour (30 min.) and the full hour (60/00 min.) has been indicated at $\phi$.

Figure 9:
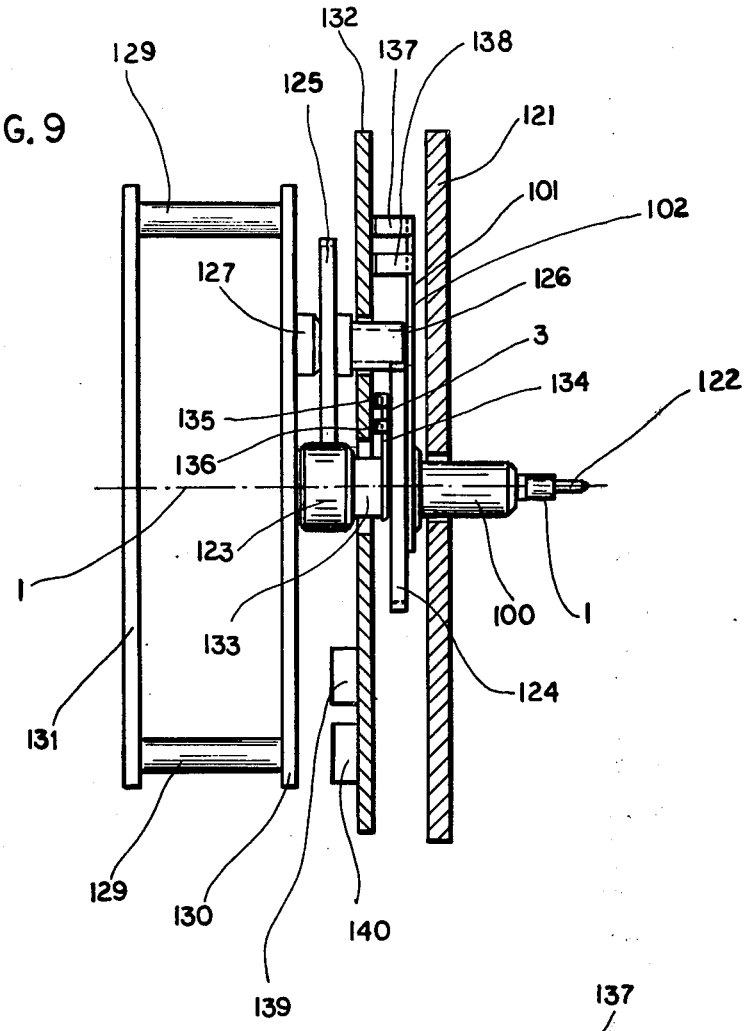
FIG. 9 is a cross-sectional view of part of a clockwork with contact members forming part of the system of FIG. 1.

FIG. 9 shows a specific construction of the switches 2, 101 of FIG. 1 incorporated in the clockwork.

The minute shaft 1, hour shaft 100 and second-hand shaft 122 of the clockwork project through a clock dial 121 in their usual nested relationship. The minute shaft 1 carries a pinion 123; the hour shaft 100 is rigidly connected with a gear 124. Pinion 123 engages a gear 125 which is rigid with a pinion 126 in mesh with gear 124. A stud 127 carrying gears 125, 126 is mounted on a plate 130 which, together with another plate 131 and a set of connecting bolts 129, forms part of a frame holding the clock mechanism.

A printed-circuit board, constituting the aforementioned carrier plate 132, is arranged between the plate 130 and the dial 121. This printed-circuit board 132 is pentrated by the minute shaft 1 and the pinions 123 and 126; gear 124 lies between the printed-circuit board 132 and the dial 121.

Figure 9B:
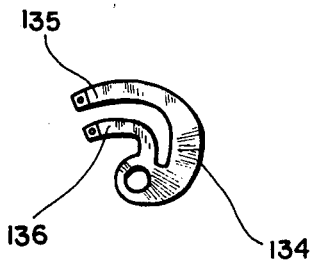
FIG. 9*b* is a face view of another contact member shown in FIG. 9.

A hub 133 of pinion 123 carries the contact arm 3 between the board 132 and the gear 124. The contact arm 3 is designed as a resilient wiper blade 134 and scans the contact arc 4 on the board 132. This blade 134 is rigidly connected with pinion 123 and rotates together with the latter. The blade 134 (see also FIG. 9*b*) carries two resilient tongues 135, 136, tongue 135 scanning the contact arc 4 which extends over an angular range of 180° in the area of $X^{30}-X^{60}$, i.e. over a path of 30 minutes. The other tongue 136 scans another contact arc connected to ground potential O, the latter arc being also carried on the board 132 and extending over a somewhat larger angle, e.g. of about 200°.

Figure 9A:
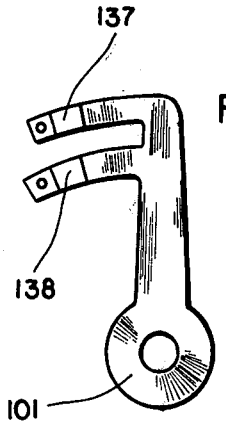
FIG. 9*a* is a face view of one of the contact members of FIG. 9.

The gear 124 is made of an insulating material, preferably a plastic. It carries the wiper blade 101 of the switch 102, that blade being likewise provided with two resilient tongues 137, 138 which scan respective conductor banks on the printed-circuit board 132; see also FIG. 9*a*. The blade 101 extends beyond pinion 126 so that a full range of 360° is available for the scanning of its conductor banks printed on the board.

The assembly shown in FIG. 9 permits a compact design of the control assembly for the electrical striking mechanism pursuant to my invention. Essential components 139, 140 of the electronic control circuit and of the clockwork itself (such as a crystal-controlled oscillator) may be arranged on the board 132 and can be connected with the remainder of the circuit by way of their printed conductors.

The arrangement according to FIG. 9 is particularly suitable for flat timepieces.

Figure 10:
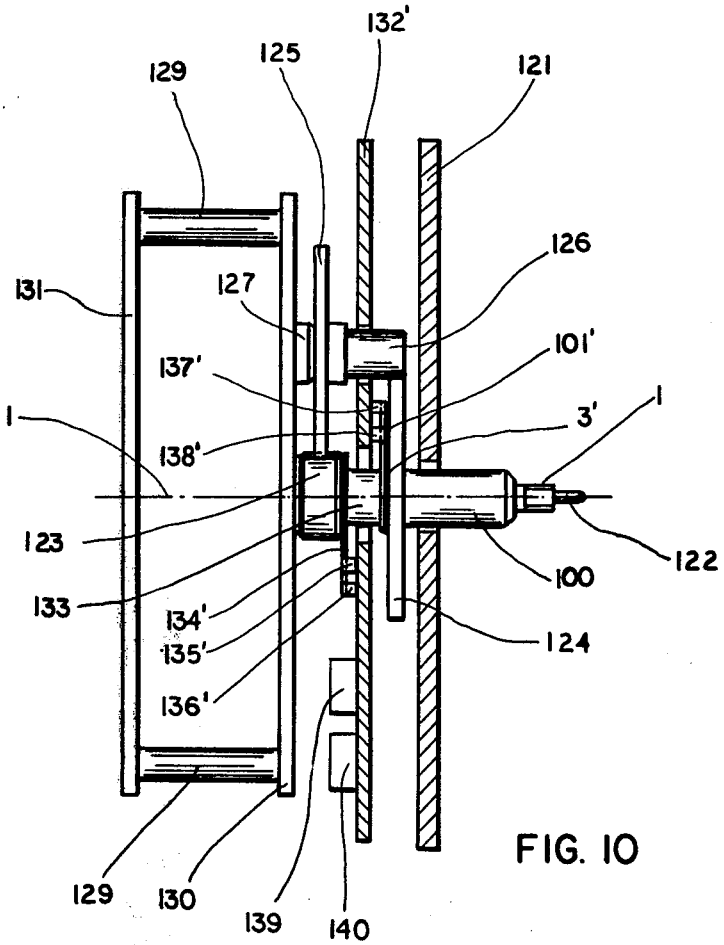
FIG. 10 is a view similar to FIG. 9, showing a modification.

A modified mounting for switches 2, 102 has been illustrated in FIG. 10. In this instance, a printed-circuit board 132' is provided with conductor arrays on both sides. The blade 134' of contact member 3, carrying tongues 135', 136', is now arranged between pinion 123 and the board 132' and scans bank contacts disposed on the side of the printed-circuit board remote from gear 124. The blade 101', on the other hand, is arranged between the printed-circuit board 132' and the gear 124, rotating with the latter and carrying tongues 137', 138' scanning respective contact banks which form the terminals I–XII, spaced 30° apart, and a continuous connection to resistor 105 and inverter 103 (FIG. 1).

The assembly of FIG. 10 is particularly suitable for use in timepieces of relatively small diameter.

Figure 11:
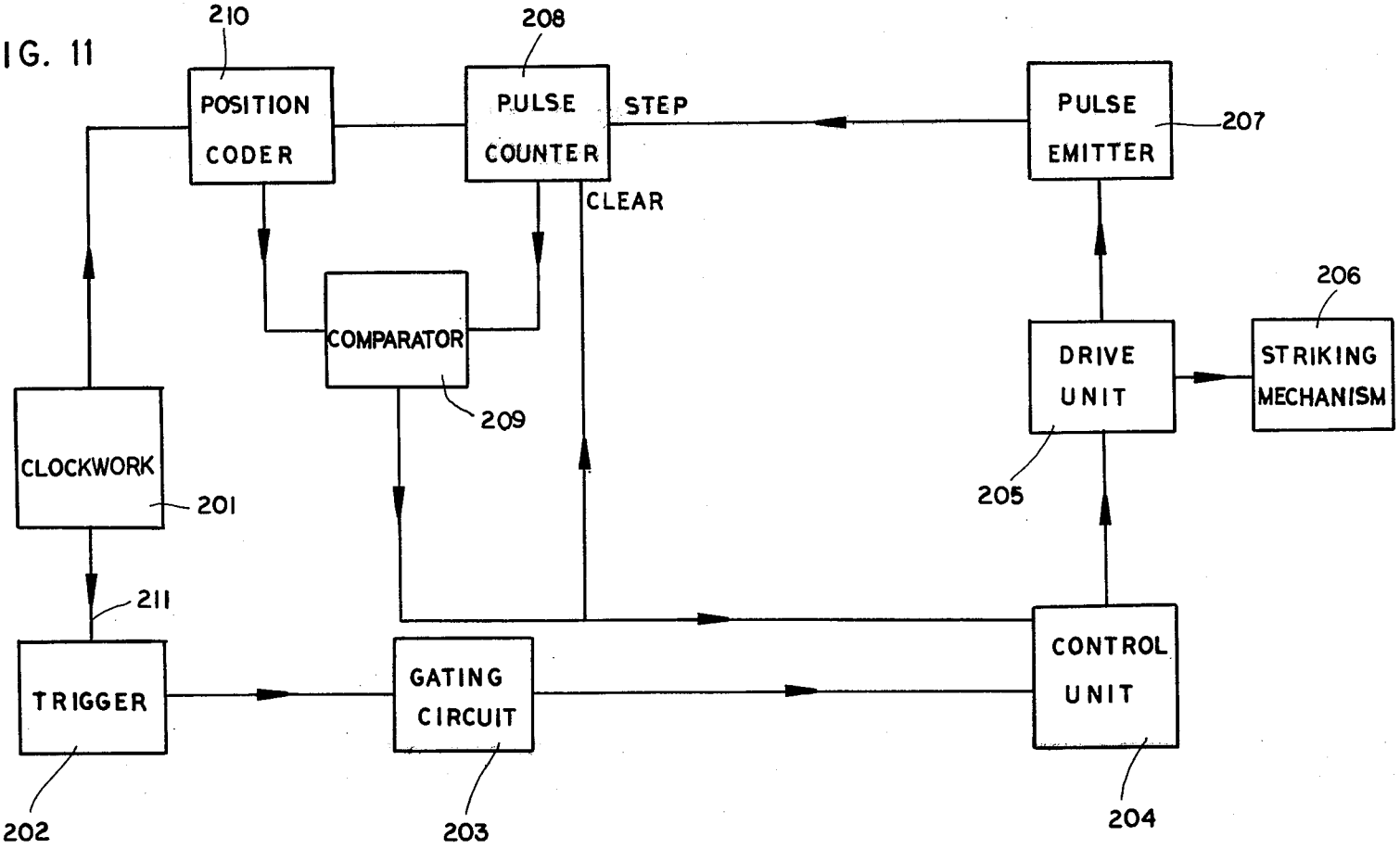
FIG. 11 is a block diagram of a control system representing a second embodiment of my invention.

FIG. 11 shows the overall layout of a system generally similar to the one just described but representing a second embodiment.

A clockwork 201 actuates, by its minute shaft, a trigger switch 202 which periodically activates, at the full hour and at the half-hour, an electronic gating circuit 203 to apply a start signal to an electronic control unit 204; this control unit thereupon activates a drive unit 205 for the operation of a striking mechanism 206. A strike may consist of a single note or a sequence of notes.

With each strike, an electronic pulse emitter 207 is caused to transmit a counting pulse to a binary counter 208. The reading of counter 208 is confronted by an electronic comparator 209 with the output of a coder 210 coupled with the hour shaft of the clockwork 201. When the comparator 209 detects a match between the readings of position coder 210 and counter 208, it emits a pulse which deactivates the drive unit 205 via control unit 204 and also clears the electronic counter 208.

Figure 12:
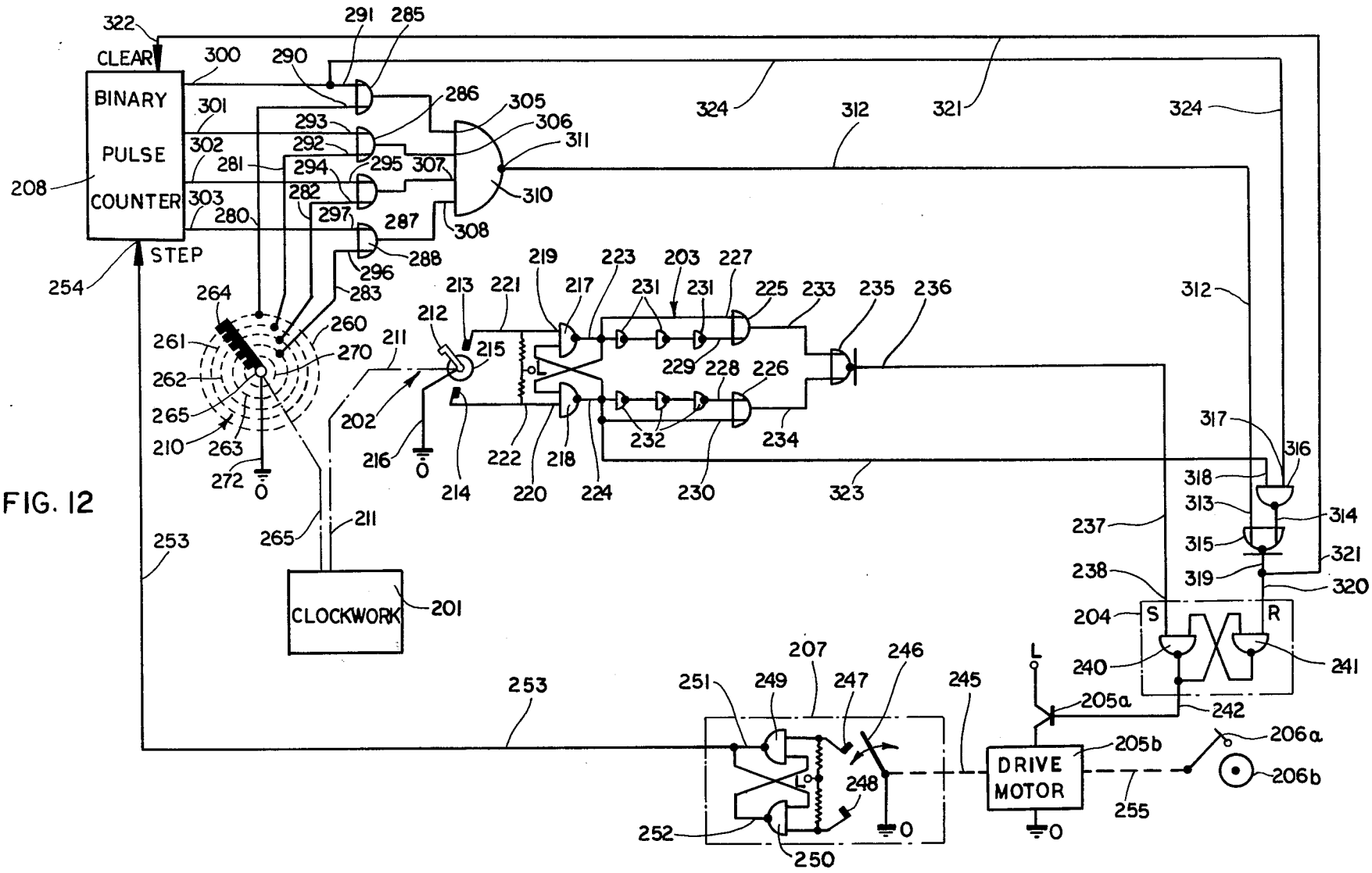
FIG. 12 is a circuit diagram similar to FIG. 1 but relating to this second embodiment.

FIG. 12 shows details of the system of FIG. 11.

The minute shaft 211 of clockwork 201 carries a wiper arm 212 of trigger switch 202 which engages a bank contact 213 at the top and a bank contact 214 at the bottom of each hour. The two bank contacts 212 and 213 are mounted on a printed-circuit board 259 (FIG. 16) as described with reference to FIGS. 9 and 10. Wiper 212 is permanently connected, by way of an annular contact strip 215 on the printed-circuit board, to a line 216 held at ground potential O.

Gating circuit 203 comprises a flip-flop formed by two cross-connected NAND gates 217, 218 whose inputs 219, 220 are connected by lines 221, 222 with contacts 213, 214 of switch 202. Each NAND gate 217, 218 has an output 223, 224 connected directly to one input 227, 230 and by way of three cascaded inverters 231, 232 to the other input 229, 228 of a respective OR gate 225, 226; outputs 233, 234 of these OR gates are combined in a NOXOR gate 235. In the general manner described above, this NOXOR gate 235 is switched whenever the arm 212 touches the contact 213 on the full hour or the contact 214 on the half-hour, thereby grounding either the input 219 of NAND gate 217 or the input 220 of NAND gate 218. This results in switching either the output 223 or the output 224 permanently to L-potential. Because of the phase delay introduced by inverters 231 or 232, a brief start signal is thereby again generated in the output 236 of gate 235 as will be apparent from FIGS. 15*a*–15*f*.

Figure 15A:
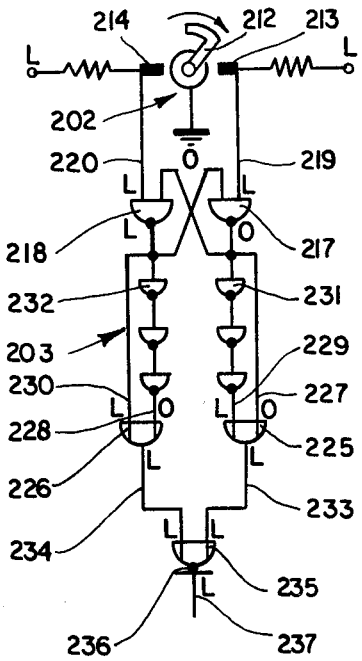
FIGS. 15*a*–15*f* show part of the circuit diagram of FIG. 12 in six different phases of operation.

In the position of FIG. 15*a* the wiper 212 has already left the contact 214 but has not yet reached the contact 213. NAND gate 218 conducts whereas NAND gate 217 is blocked. Their outputs 224, 223, therefore, carry potential L and potential O, respectively. At the output 236 of the NOXOR gate 235 there appears potential L, which therefore lies also at the setting input 238 of the flip-flop comprising NAND gates 240, 241 and constituting the electronic control unit 204 as shown in FIG. 12.

Figure 15B:
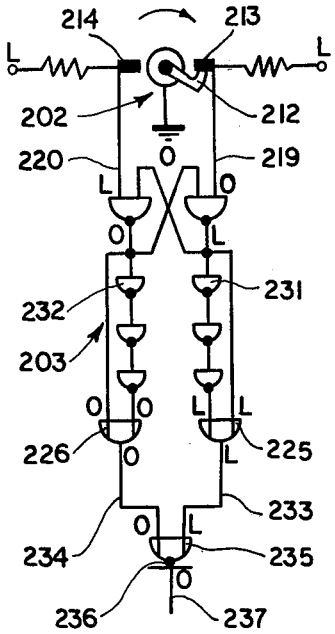
Figure 15C:
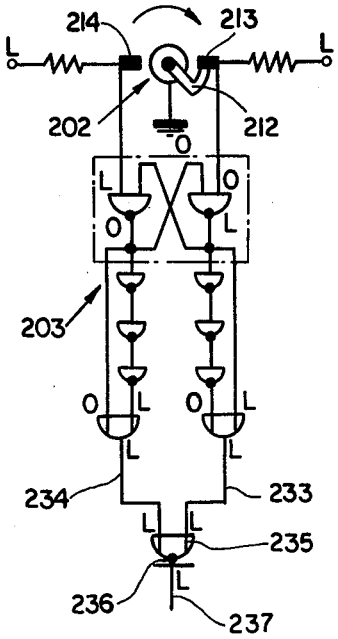

In the position of FIG. 15*b* the wiper 212 has engaged the contact 213 of switch 202 precisely at the full hour, grounding that contact. The output 223 of NAND gate 217 is switched to potential L while potential O appears simultaneously at output 224 of NAND gate 218. Accordingly, the potentials at inputs 227 and 230 of the OR gates 225, 226 change too. Owing to the delay lines 231, 232 in series with inputs 228 and 229, the potentials there change slightly later, with the result that the output 236 of gate 235 is briefly switched to potential O; this acts as a start signal for setting the flip-flop 204. Shortly thereafter, the mode of energization of circuit 203 changes to that shown in FIG. 15*c*, output 236 being switched back to potential L.

Figure 15D:
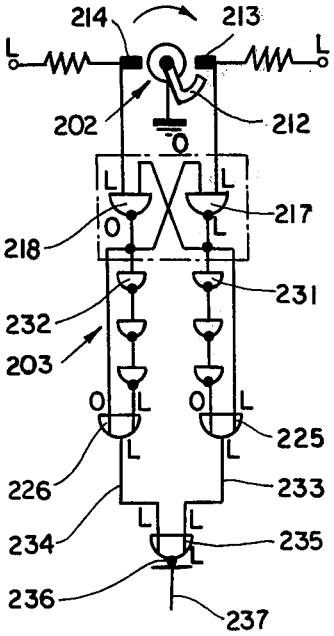

After an interval sufficient for the execution of the maximum number of strikes (12), wiper 212 leaves the contact 213. The potential distribution then existing, shown in FIG. 15*d*, is the same as that of FIG. 15*c*. The engagement of the bank contacts 213 and 214 during the maximum period of the corresponding strike signal is designed to obviate any possible malfunction caused, for instance, by downstream switching operations which could reverse the flip-flop formed by NAND gates 217, 218.

Figure 15E:
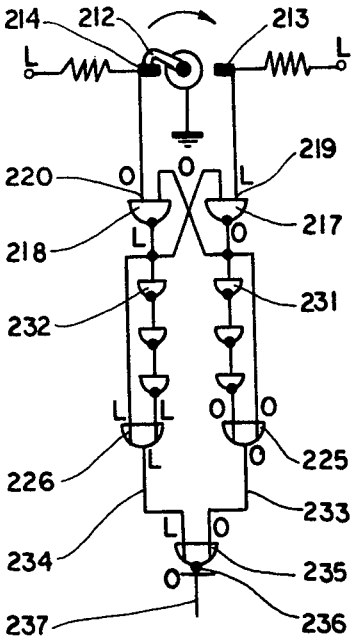

FIG. 15*e* shows the conditions which prevail at the exact half-hour, i.e. at the moment of conductive engagement between wiper 212 and contact 214. The flip-flop 217, 218 of the electronic pulse emitter 203 then switches over, i.e. the output 224 of NAND gate 218 carries potential L while the output 223 of NAND gate 217 carries potential O. Because of the delay introduced by lines 231, 232, a potential O again appears briefly at the output 233 of OR gate 225 and therefore also at the output 236 of NOXOR gate 235 as a start signal for control unit 204. NAND gate 240 of unit 204 is now conductive and energizes its output 242.

Figure 15F:
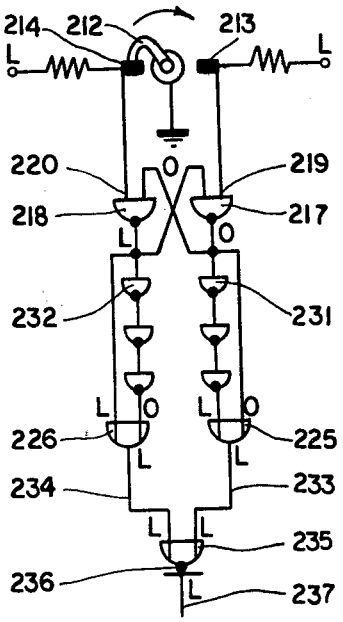

After the end of the delay introduced by inverters 231, 232, the potential distribution illustrated in FIG. 15*f* is attained and is maintained at least for the duration of the half-hour strike. When after this time the contact between the wiper 212 and the conductor 214 is interrupted, the potential distribution of FIG. 15*a* recurs.

When the NAND gate 240 of flip-flop 204 conducts, a transistor 205*a* is turned on and cuts in a drive motor 205*b* to activate the striking mechanism here shown to comprise a hammer 206*a* and a bell or gong 206*b*.

The drive motor 205*b* also operates the electronic pulse emitter 207 by way of a shaft 245. With the shaft 245 rotates a contact arm 246 which sweeps with each full rotation a pair of bank contacts 247 and 248 in succession. The grounding of contact 247 by the arm 246 sets a flip-flop formed by two cross-connected NAND gates 249, 250 whereby a counting pulse is transmitted via a lead 253 to the stepping input 254 of an electronic counter 208, this counting pulse being repeated with each additional strike. The flip-flop is reset, during every revolution of motor shaft 245, by a brief grounding of contact 248.

The position coder 210 comprises four contact arcs 260, 261, 262, 263, which are arranged concentrically within carrier plate 259 (FIG. 16) with progressively smaller radii and are brushed by a wiper blade 264 rotated on an hour shaft 265. Attached to the blade are four elastic tongues 266–269 which sweep the four contact arcs 260–263 during rotation of the hour shaft 265.

A continuous annular bank contact 270, which is swept by a fifth tongue 271 of wiper 264 and connects that wiper to ground potential O, is concentrically provided within arcs 260–263.

Figure 17:
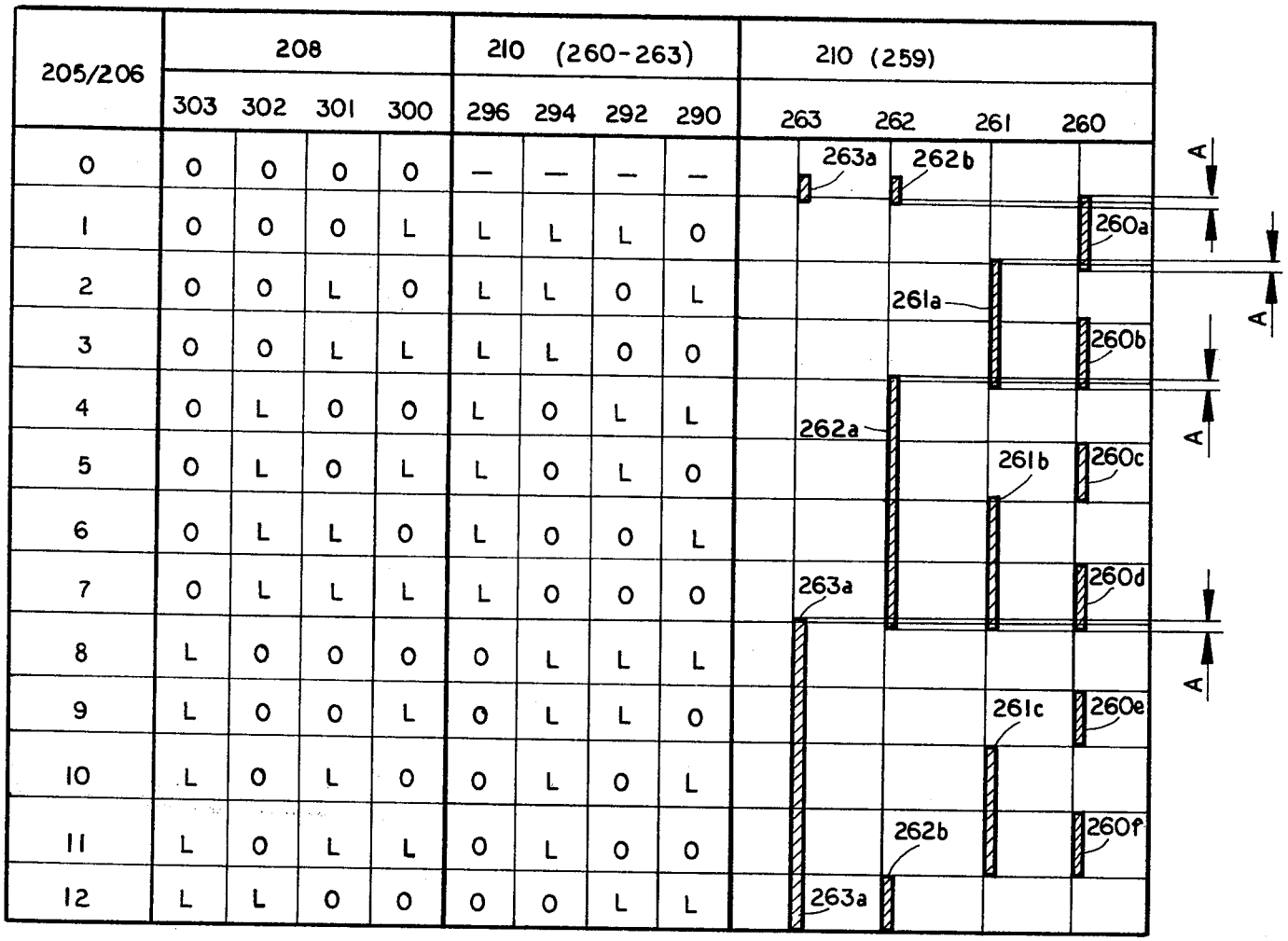
FIG. 17 is a code diagram for the embodiment of FIGS. 11–16.

The contact arcs 260–263 are arrayed pursuant to a binary code illustrated in FIG. 17. Arc 260 is divided into six segments 260*a*, 260*b*, 260*c*, 260*d*, 260*e*, 260*f*; arc 261 has three segments 261*a*, 261*b*, 261*c*; arc 262 is split into two segments 262*a*, 262*b*; and arc 263 consists of a single segment 263*a*. The several segments of a divided arc are interconnected by ancillary conductors 273, 274, 275.

The 4-bit binary code shown in FIG. 17 affords $2^4=16$ combinations of which, however, only 13, that is 0 and 1–12, are used.

In FIG. 17, column 205/206 shows the number of strikes executed at successive hours. Column 208 is a truth table showing the energization of the stage outputs 300–303 of the electronic counter 208 tied to respective inputs 291, 293, 295, 297 of a set of OR gates 285–288 forming part of the comparator 209 of FIG. 11.

In contrast, column 210/260–263 shows the sequence of engagement of the contact arcs 260–263 by wiper 264 during consecutive hours. In will be seen that the code of the arcs 260–263 on plate 259 is complementary to the pattern of energization of output leads 300–303 of counter 208. A bit "0" in column 210/260–263 is represented by the grounding of the corresponding arc segment through wiper 264 brought about by the segment position shown in column 210/259 of FIG. 17.

The coder 210 is connected via four leads 280, 281, 282, 283, originating at contact arcs 260, 261, 262, 263, to respective inputs 290, 292, 294, 296 of OR gates 285, 286, 287 and 288 serving as discriminating stages of comparator 210. These OR gates work into respective inputs 305–308 of a NAND gate 310 which is cut off whenever two complementary and therefore matching codes are read out from coder 210 and counter 208.

At that instant the potential O appears at the output 311 of NAND gate 310 to serve as a stop signal for arresting the striking mechanism 206*a*, 206*b* and clearing the counter 208.

An advantageous layout of the coder 210 provides that the arc segments 260*a*–260*f* for the lowest-ranging bit positions are arranged on an outer circle with the largest radius, while the arc segments 261*a*–261*c*, 262*a*, 262*b* and 263*a* for the higher-ranking bit positions are arranged on circles of progressively decreasing radii; conductor 270 lies on an inner circle of the smallest radius.

This arrangement results in a more exact scanning of the more numerous shorter arc segments 260*a*–260*f* for the wiper 264. The reduced scanning accuracy for the segments of greater arc length is easily tolerated.

In order to guarantee safe operation of the striking mechanism, an overlap A is provided between arc segments ending and beginning at a given level in the scanning direction, as illustrated in column 210/259 of FIG. 17. The extent of this overlap is determined by the possible dimensional tolerances of the segments 260*a*–260*f*, 261*a*–261*c*, 262*a*, 262*b* and 263*a* on the one hand and the scanning tongues 266–269 of the wiper 264 on the other hand. Such an overlap is particularly required at locations where the complete interruption of the scan is otherwise possible, as for instance at the transition from code LOOO to code OLLL between the 7th and 8th hours or from code LOOO to code OLLL between the 12th and 1st hours. Thus, there should be no possibility of energizing all four gate inputs 290, 292, 294, 296 simultaneously with potential L since the code LLLL is complementary to the normal pattern of energization (0000) of the counter outputs. Should this occur in an intermediate position, e.g. while the clock is being set, continuous strikes might be executed by the striker mechanism until the wiper 264 is sufficiently advanced by the hour shaft 265.

Figure 16:
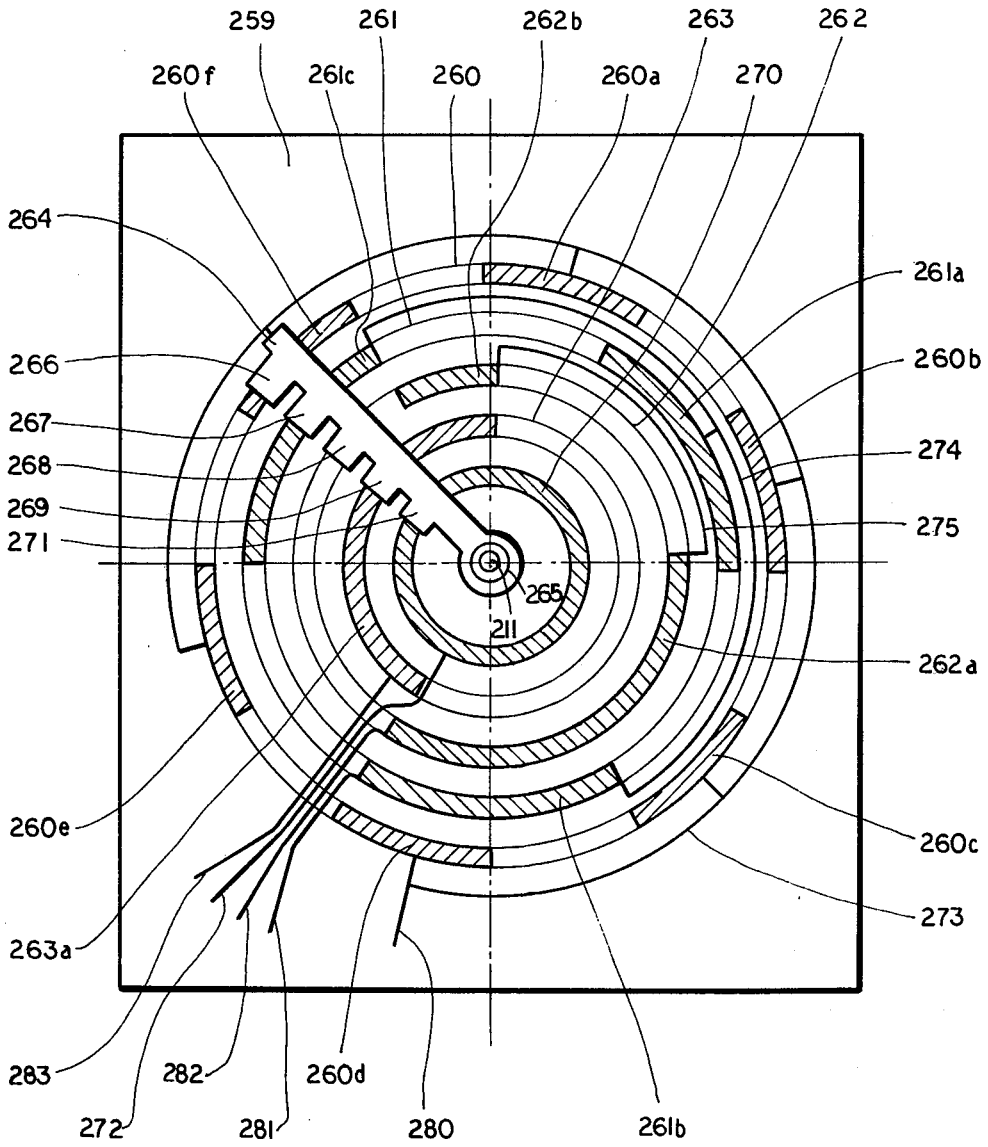
FIG. 16 is an enlarged detail view of a contact assembly included in the system of FIG. 12.

Another advantageous feature of the coder 210 is apparent from FIG. 16 and lies in the fact that the ancillary conductors 273–275 are interrupted at aligned locations to form a radial gap through which associated leads 281, 282, 283 are brought out in the form of narrow, closely adjoining conductor strips. The lead 280 to arc 260 can be connected to any of its segments 260*a*–260*f* or to the ancillary conductor 273, because no overlapping problems occur there. The lead 272 for the innermost conductor 270 passes through the same gap. Advantageously, the interruption of the ancillary conductors 273–275 occurs between positions LOOO (segments 262*a*, 261*b*, 260*d*) and OLLL (segment 263*a*).

The trigger mechanism 202 can also be designed in a form similar to coder 210, with the contacts 213 and 214 carried on the same printed-circuit board 259.

The output 311 of NAND gate 310 is tied by a lead 312 to an input 313 of a NOXOR gate 315 having a second input 114 connected to the output of a NAND gate 316; gates 315 and 316 constitute a discriminating network which is the counterpart of the logic network 95, 110–115 shown in FIG. 1.

The input 317 of this NAND gate 316 is connected to the output lead 300 of counter 208 which is the first lead energized. The other input 318 of NAND gate 316 is tied to the output 224 of NAND gate 218 in circuit 203. The output 319 of NOXOR gate 315 is connected to the resetting input 320 of flip-flop 204. A lead 321 extends from the output 319 of NOXOR gate 315 to the clearing input 322 of counter 208.

If the striking mechanism is activated on the full hour, the pulses generated by the electronic pulse emitter 207 advance the counter 208 until the number of strikes corresponds to the position of the hour hand and of coder 210. This results in the grounding of the output 311 of NAND gate 310 and of the input 313 of gate 315. At the output 224 of the NAND gate 218 there now also exists the potential O, so that NAND gate 316 is not switchable at this time. Thus, the potential O lies at the input 313 of the NOXOR gate 315 whereas the potential L lies at its input 314. As a result, potential O appears at the output 319 of gate 315 and at the input 320 of flip-flop 204, resetting the latter and cutting off the transistor 205*a*.

On the other hand, if the activation of the striking mechanism is initiated on the half-hour by the grounding of contact 214, potential L lies at the output 224 of NAND gate 218. After the counter 208 has counted the first strike, potential L also appears at its output 300. These time potentials are delivered—on the one hand by lead 323, and on the other hand by lead 324—to the inputs 317 and 318 of NAND gate 316, so that potential O is present at its output 314. At input 313 of gate 315 lies, however, potential L from output 311 of NAND gate 310, so that already after the first strike NOXOR gate 315 is switched to reset the flip-flop 204.

Figure 18:
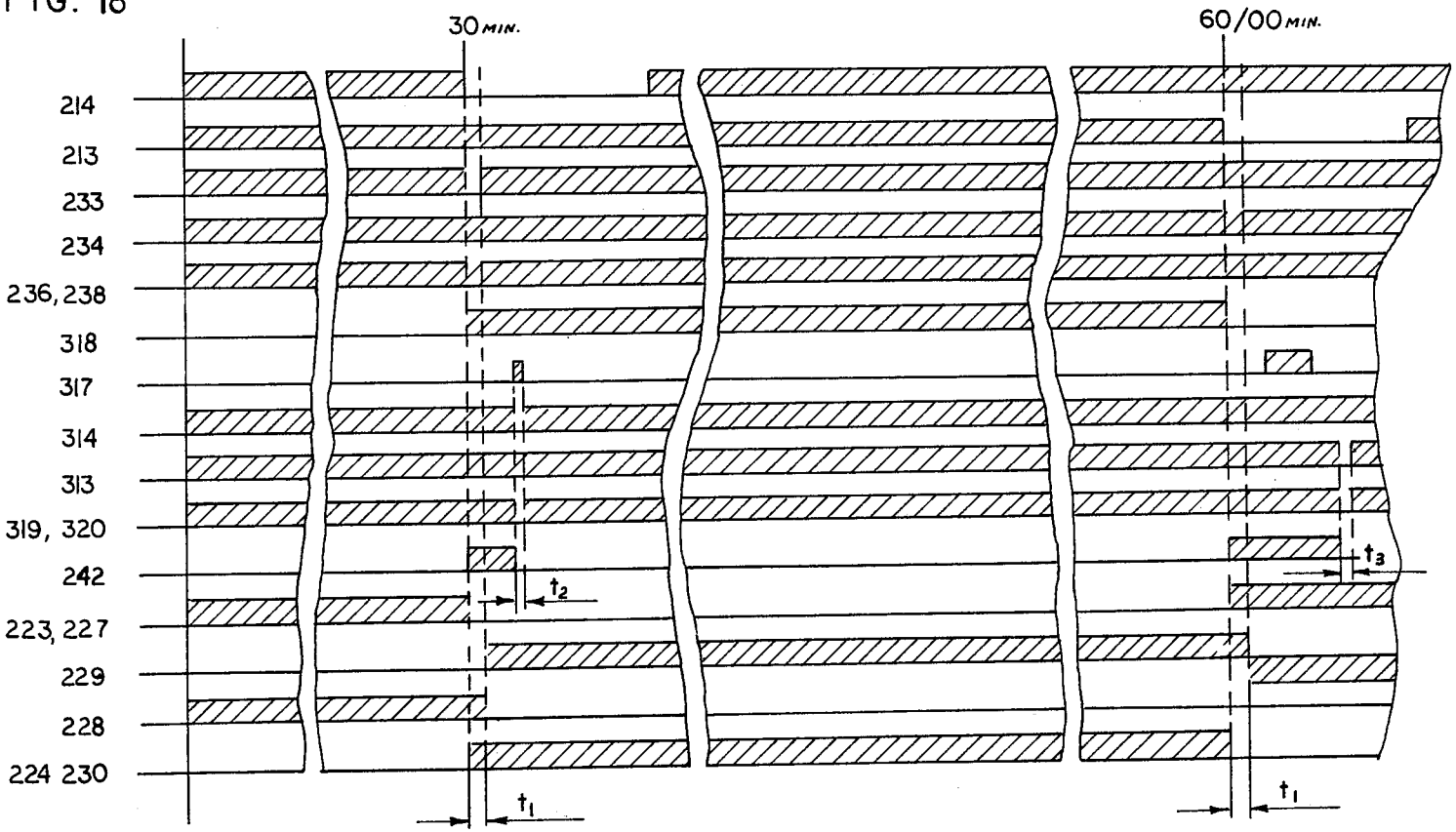
FIG. 18 is a set of graphs similar to FIG. 8 but relating to the second embodiment.

The graphs of FIG. 18 show the energization of the inputs and outputs of various logic elements in the system of FIG. 12. The start signal at flip-flop input S (238) has been indicated at $t_1$; the stop signal at input S (320) is seen at $t_2$ (on the half-hour) and at $t_3$ (on the full hour).

The use of simple OR gates 285–288 (in lieu of XOR gates, which of course would also work) is facilitated by the fact that the ascending pulse count read out on leads 300–303 invariably will complement the binary signal combination appearing on the output leads of position coder 210 before any duplication of L-signals can occur.

Figure 13:
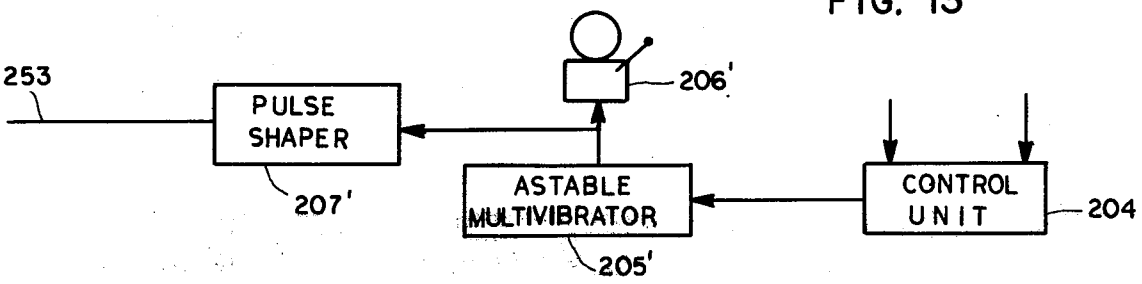
FIGS. 13 and 14 show partial modifications of the system of FIG. 12.

FIG. 13 shows a modification of that system in which a striking mechanism 206' is actuated by an astable multivibrator 205'; mechanism 206' may be a one-stroke bell. Such an arrangement works without contact, displays little susceptibility to trouble and exhibits a favorable current consumption. The pulse emitter 207' is here shown as a pulse shaper in the output of multivibrator 205'.

Figure 14:
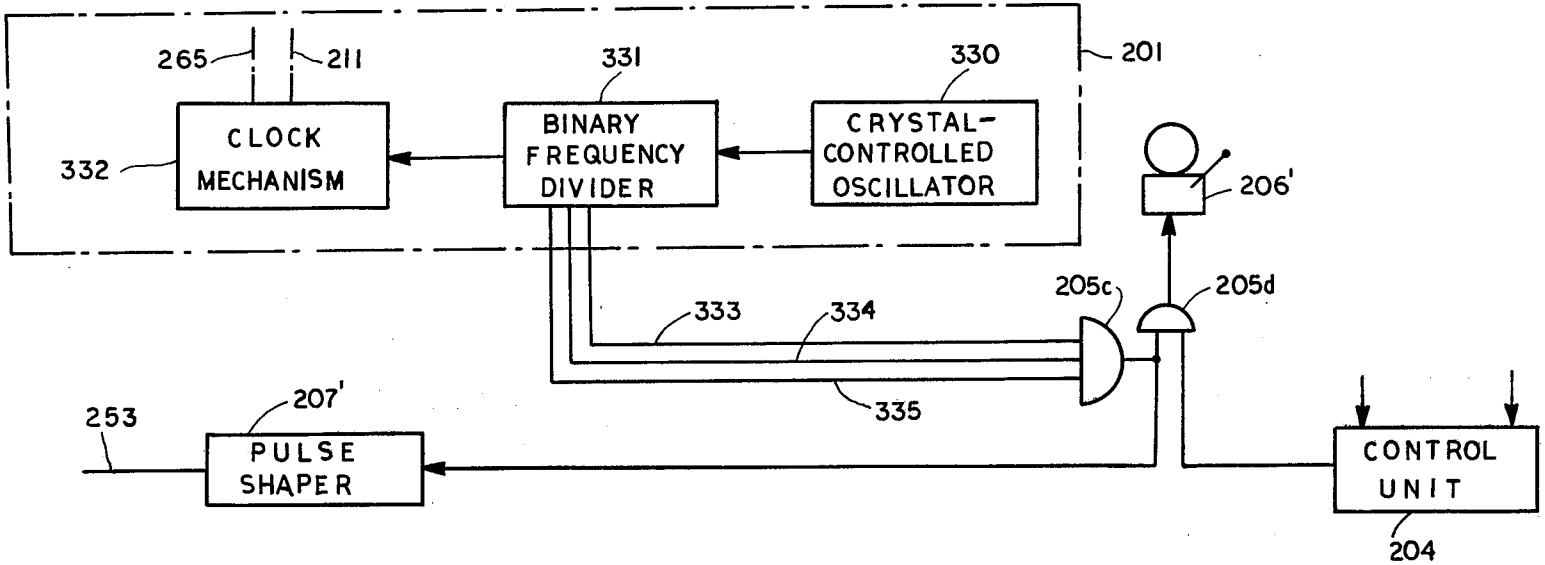

FIG. 14 is a schematic representation of another modification of the circuit arrangement according to FIG. 12. In this instance a plurality of stage outputs 333, 334, 335 of a binary frequency divider 331, driven by a crystal-controlled oscillator 330, are combined in an AND gate 205*c* to generate driving pulses of low duty ratio which are passed by another AND gate 205*d* as long as flip-flop 204 is set. Oscillator 330 and divider 331 also drive the mechanical part 332 of clockwork 201.

Drive unit 205 and pulse emitter 207 could be combined into a single unit.

Figure 19:
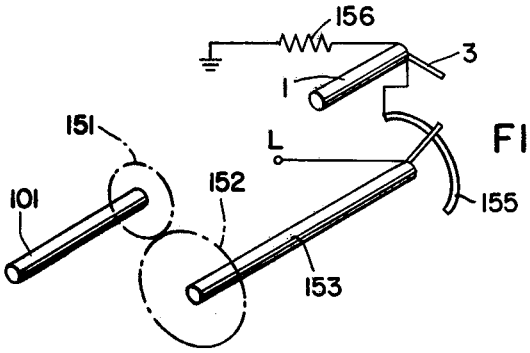
FIG. 19 is a diagrammatic view of an additional detail.

In FIG. 19 I have illustrated the provision of a circuit breaker controlled by the clockwork for disabling the striking mechanism during certain night-time hours, e.g. for an 8-hour period starting at 11 P.M. (2300 hours). The hour shaft 100 of FIG. 1 is here coupled, via a step-down transmission 151, 152, with an ancillary shaft 153 rotating at half the speed of shaft 100 (a similar arrangement could, of course, be provided for the system of FIG. 12). Shaft 153 carries a wiper arm 154 which is energized with potential L and, during the aforementioned period, engages a bank contact 155 tied to switch arm 3; the latter, grounded through a resistor 156, is therefore ineffectual throughout that period to switch the gating circuit 6–21 (or the flip-flop 217, 218 in the system of FIG. 12).

I claim:

1. In a timepiece comprising a clockwork with a minute shaft and an hour shaft, and a striking mechanism for announcing at least the full hour by sounding a variable number of strikes, the combination therewith of:

normally inactive drive means for operating said striking mechanism;

a normally reset flip-flop with a setting input, a resetting input, and a set output connected to said drive means for activating same;

trigger means including a first rotating contact member coupled with said minute shaft for delivering a start signal to said setting input at least once per hour to activate said drive means;

electronic pulsing means synchronized with said striking mechanism for emitting a number of voltage pulses proportional to said number of strikes;

a pulse counter with a stepping input connected to said pulsing means, output circuitry including a set of leads generating a pattern of energization determined by the count of said voltage pulses, and a clearing input for establishing a zero pulse count; and deactivating means including said output circuitry and a second rotating contact member coupled with said hour shaft for delivering a stop signal to said resetting and clearing inputs upon said pattern of energization bearing a predetermined relationship with the position of said hour shaft.

2. The combination defined in claim 1 wherein said trigger means comprises an electronic gating circuit switchable by said first contact member in a half-hour position and in a full-hour position thereof, said deactivating means further including a logic network connected to said gating circuit for generating said stop signal independently of the position of said hour shaft in said half-hour position.

3. The combination defined in claim 2 wherein said gating circuit comprises two substantially identical sections terminating at respective inputs of an anticoincidence gate of the Exclusive-OR type, each of said sections being divided into a pair of parallel branches of relatively inverting character and with a relative phase delay connected to the respective input of said anticoincidence gate through a further logic gate changing its state of conduction in response to a switchover during a brief interval determined by said phase delay in which said branches carry signals of identical logical values.

4. The combination defined in claim 3, further comprising conductor means connected between said sections and a source of input voltage therefor, said conductor means being engageable by said first contact member for changing said input voltage in said half-hour and full-hour positions.

5. The combination defined in claim 4 wherein said conductor means comprises a single bank contact connected in parallel to said sections and engageable by said first contact member during a 30-minute sweep between said half-hour and full-hour positions.

6. The combination defined in claim 5 wherein said further logic gate is a NAND gate, further comprising an inverter inserted between said bank contact and one of said sections.

7. The combination defined in claim 4 wherein said conductor means comprises a pair of bank contacts respectively connected to said sections and engageable by said first contact member for a short period in said half-hour and full-hour positions, respectively.

8. The combination defined in claim 7 wherein said further logic gate is an OR gate, further comprising a multivibrator with two cross-connected NAND gates respectively inserted between said bank contacts and said sections.

9. The combination defined in claim 4 wherein one of said branches of each section includes an odd number of cascaded inverters establishing said relatively inverting character as well as said phase delay.

10. The combination defined in claim 2 wherein said logic network comprises a first gate and a second gate in cascade, said first gate having input connections to said gating circuit and to a lead of said output circuitry energized by said pulse counter upon the sounding of the first strike, said second gate having an input connection to a point of said output circuitry whose potential changes upon said pattern of energization and the position of said hour shaft bearing said predetermined relationship.

11. The combination defined in claim 10 wherein said second gate is a NAND gate.

12. The combination defined in claim 11 wherein said leads are twelve in number and are cyclically energized by a decoder forming part of said output circuitry, said leads terminating in an array of bank contacts swept by said second contact member in a 12-hour period, said point being tied to said second contact member.

13. The combination defined in claim 11 wherein said output circuitry further comprises a comparison network with input connections to said leads and to a set of contact arcs swept by said second contact member in a 12-hour period, said point being an output of said comparison network.

14. The combination defined in claim 13 wherein said comparison network comprises a plurality of discriminating stages working into a coincidence gate, each discriminating stage having one input tied to one of said leads and another input tied to one of said contact arcs.

15. The combination defined in claim 14 with four contact arcs and four discriminating stages, three of said contact arcs being divided into different numbers of segments arrayed according to a four-bit binary code assuming different values from one hour to the next.

16. The combination defined in claim 15 wherein said binary code is the complement of the pattern of energization of said leads by said pulse counter, said discriminating stages being OR gates.

17. The combination defined in claim 15 wherein said contact arcs are printed on a carrier plate traversed by said hour shaft.

18. The combination defined in claim 17 wherein said contact arcs have progressively larger numbers of segments with increasing distance from said hour shaft.

19. The combination defined in claim 17 wherein said carrier plate also supports an annular conductive strip engaged by said second contact member and connected to a source of fixed potential.

20. The combination defined in claim 17 wherein said carrier plate also supports conductor means coacting with said first contact member.

21. The combination defined in claim 10 wherein said second gate is an anticoincidence gate of the Exclusive-OR type.

22. The combination defined in claim 1 wherein said drive means comprises a motor, said pulsing means comprising a pulse generator driven by said motor.

23. The combination defined in claim 1 wherein said drive means comprises an astable multivibrator, said pulsing means being an output circuit of said multivibrator.

24. The combination defined in claim 1 wherein said drive means comprises a crystal-controlled oscillator forming part of said clockwork and a binary frequency divider connected to said oscillator, said frequency divider having a plurality of stage outputs logically interconnected to generate a train of driving pulses with a duty ratio substantially smaller than 1:2.

25. The combination defined in claim 1, further comprising a circuit breaker controlled by said clockwork for disabling said drive means during certain night-time hours.

26. The combination defined in claim 1 wherein said trigger means and said deactivating means comprise bank contacts on a common carrier respectively engaged by said first and second members.

27. The combination defined in claim 26 wherein said carrier is a printed-circuit board.

28. The combination defined in claim 27 wherein said printed-circuit board is traversed by said minute shaft and said hour shaft, said first and second contact members being wiper blades directly mounted on said minute and hour shafts, respectively.

29. The combination defined in claim 28 wherein said printed-circuit board also supports integrated circuitry forming part of said clockwork.

* * * * *